US011495375B2

(12) United States Patent
Pizzi

(10) Patent No.: US 11,495,375 B2
(45) Date of Patent: Nov. 8, 2022

(54) PTC-EFFECT COMPOSITE MATERIAL, CORRESPONDING PRODUCTION METHOD, AND HEATER DEVICE INCLUDING SUCH MATERIAL

(71) Applicant: ELTEK S.P.A., Casale Monferrato (IT)

(72) Inventor: Marco Pizzi, Casale Monferrato (IT)

(73) Assignee: ELTEK S.P.A., Casale Monferrato (IT)

( * ) Notice: Subject to any disclaimer, the term of this patent is extended or adjusted under 35 U.S.C. 154(b) by 509 days.

(21) Appl. No.: 16/500,661

(22) PCT Filed: Mar. 29, 2018

(86) PCT No.: PCT/IB2018/052201
§ 371 (c)(1),
(2) Date: Oct. 3, 2019

(87) PCT Pub. No.: WO2018/185627
PCT Pub. Date: Oct. 11, 2018

(65) Prior Publication Data

US 2021/0118596 A1 Apr. 22, 2021

(30) Foreign Application Priority Data

Apr. 7, 2017 (IT) ..... 102017000038877

(51) Int. Cl.
*H01C 7/02* (2006.01)
*H05B 3/14* (2006.01)
*H05B 3/24* (2006.01)

(52) U.S. Cl.
CPC ..... *H01C 7/027* (2013.01); *H05B 3/146* (2013.01); *H05B 3/24* (2013.01); *H05B 2203/01* (2013.01); *H05B 2203/02* (2013.01)

(58) Field of Classification Search
CPC ..... H01C 7/027; H05B 3/146; H05B 3/24; H05B 2203/01
See application file for complete search history.

(56) References Cited

U.S. PATENT DOCUMENTS 6,197,219 B1 3/2001 Foulger
6,218,928 B1 * 4/2001 Okada ..... C22C 29/04 338/22 SD
6,396,384 B1 * 5/2002 Blok ..... H01C 7/028 252/511
8,003,016 B2 * 8/2011 Mercx ..... C08J 3/201 252/511

(Continued)

FOREIGN PATENT DOCUMENTS

WO 2016/012762 1/2016

OTHER PUBLICATIONS

International Search Report for PCT/IB2018/052201 dated Jul. 5, 2018, 3 pages.

(Continued)

*Primary Examiner* — Kyung S Lee
(74) *Attorney, Agent, or Firm* — Nixon & Vanderhye P.C.

(57) ABSTRACT

A co-continuous mouldable polymeric composite with PTC effect has a matrix that comprises at least two immiscible polymers (HDPE, POM), and an electrically conductive filler (CB) in the matrix. At least one of said immiscible polymers is high-density polyethylene (HDPE), and at least one other of said immiscible polymers is polyoxymethylene (POM).

15 Claims, 8 Drawing Sheets

(56) References Cited

U.S. PATENT DOCUMENTS

| | | | | |
|---|---|---|---|---|
| 8,465,677 | B2 * | 6/2013 | Lu | H01B 1/24 427/126.3 |
| 8,496,854 | B2 * | 7/2013 | Mercx | H01C 7/027 252/502 |
| 8,968,605 | B2 * | 3/2015 | Yue | C08L 23/0853 252/511 |
| 10,583,691 | B2 * | 3/2020 | Wu | C08K 7/06 |
| 2003/0173550 | A1 * | 9/2003 | Fox | H01B 1/24 252/500 |
| 2007/0187655 | A1 * | 8/2007 | Wang | H01B 1/22 252/511 |
| 2009/0236565 | A1 * | 9/2009 | Mercx | C08J 3/201 252/511 |
| 2013/0002395 | A1 * | 1/2013 | Luizi | H01C 17/06586 338/25 |

OTHER PUBLICATIONS

Written Opinion of the ISA for PCT/IB2018/052201 dated Jul. 5, 2018, 6 pages.

* cited by examiner

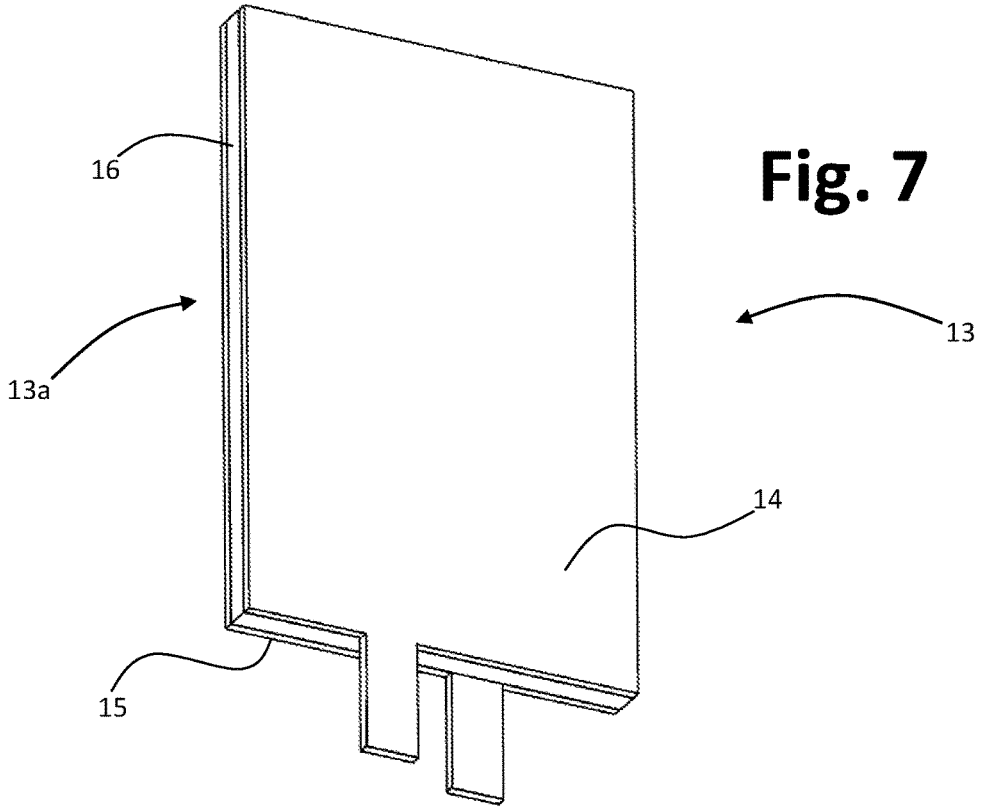
Fig. 7
Fig. 8
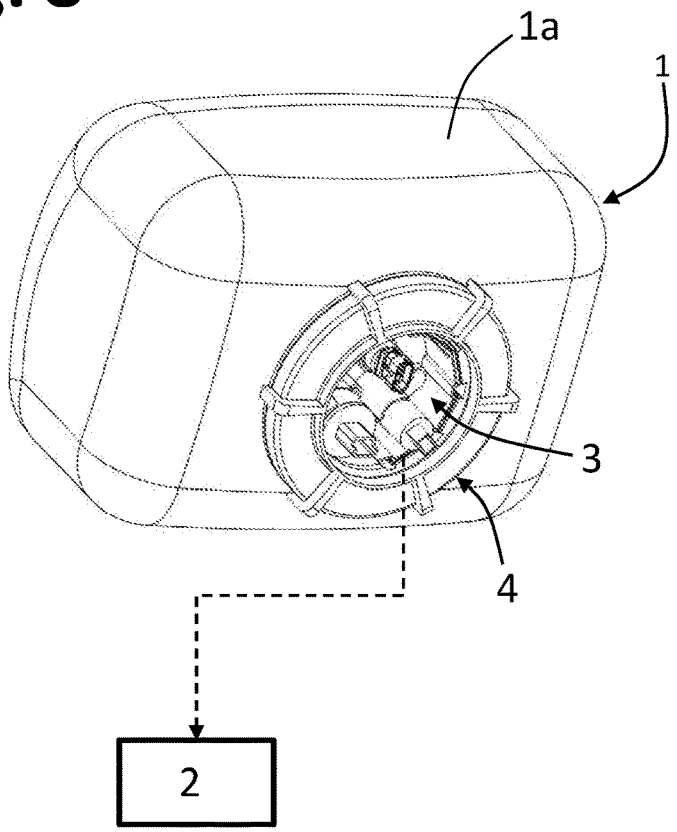

PTC-EFFECT COMPOSITE MATERIAL, CORRESPONDING PRODUCTION METHOD, AND HEATER DEVICE INCLUDING SUCH MATERIAL

This application is the U.S. national phase of International Application No. PCT/IB2018/052201 filed Mar. 29, 2018 which designated the U.S. and claims priority to IT Patent Application No. 102017000038877 filed Apr. 7, 2017, the entire contents of each of which are hereby incorporated by reference.

FIELD OF THE INVENTION

The present invention relates to polymer-based electrically conductive composite materials, in particular distinguished by a positive-temperature-coefficient (PTC) electrical resistance, i.e., materials having a PTC effect. The invention has been developed with particular reference to the use of such materials in electrical heater devices, in particular heaters associated to, or integrated in, vehicle components, such as heaters for tanks, or heaters for substances subject to freezing, or again heaters used for heating aeriform substances, such as air subject to forced circulation on the surface of the heaters. The composite materials and the heater devices according to the invention can in any case be applied also in contexts different from the preferential one provided herein.

PRIOR ART

Conductive polymeric materials are known, obtained by mixing electrically conductive particles—typically carbon black—within an insulating matrix. The electrical properties of the composite material, and in the first place its conductivity, depend upon factors linked both to the matrix and to the particles (for example, the technological/mechanical and dielectric properties of the matrix, on the one hand, and the dimensions, concentration, distance, intrinsic conductivity of the particles, on the other). In general, the behaviour of the electrical conductivity of the composite material as a function of the concentration of the conductive filler follows the plot represented in FIG. 1, which exemplifies the case of a filler constituted by particles of carbon black. Basically, below the percolation threshold, the composite is insulating, whereas at the percolation threshold the conductivity of the composite varies rapidly, until a high-conductivity zone is reached. In the proximity of the percolation threshold it is possible to obtain composites having a marked PTC (Positive Temperature Coefficient) effect, where a small expansion of the matrix due to the increase in temperature leads to a considerable variation of electrical resistance. This phenomenon is basically due to the fact that the aforesaid expansion causes an increase of the distance between adjacent particles of carbon black, thereby varying or interrupting some electrical paths within the matrix.

The composites the matrix of which is obtained using a single polymer (i.e., a single phase) that contains in a homogeneous way the conductive filler are generally not very conductive, unless extremely high concentrations of conductive filler are used, for example higher than 20 wt % of carbon black, with corresponding problems of cost, high viscosity, and poorer mouldability of the composite. Composites of this type are also distinguished by a reduced PTC effect and by a relatively low stability over time.

It has hence been proposed to use fillers in the form of carbon nanotubes or other conductive particles that have a high aspect ratio, with which it is possible to obtain percolation even with filler percentages lower than the ones referred to above (roughly from 2 wt % to 5 wt %). Also in this case, however, the PTC effect is relatively limited in so far as thermal expansion of the matrix is not sufficient to separate from one another the particles of the filler, which can continue to slide over one another instead of moving away from one another (as occurs, instead, for fillers with a substantially spheroidal geometry).

There have also been proposed alternative composite materials, defined as "co-continuous" or "heterophasic" composites, in which the matrix comprises at least two immiscible polymers, i.e., in which two different matrices that are immiscible with one another are comprised. In these materials, according to the choice of the polymers used for the matrix, different distributions of the conductive filler are obtained.

As appears, for example, from Table 1 below, in some composites—as in the case of the PP-EVA or PP-EAA mixture—there occurs a homogeneous distribution of the conductive filler in the entire matrix (or in the two polymers that constitute it), whereas in other composites the conductive filler is segregated or confined within just one of the two materials of the matrix, as in the case of the PP-HDPE mixture, where the conductive filler is concentrated within just the HDPE. In other composites still, the filler is substantially located at the interface between the two polymers of the matrix, as in the case of the HDPE-PMMA mixture.

TABLE 1

Known co-continuous composites (carbon-black filler)

| Polymeric system | | Filler distribution |
|---|---|---|
| PP | EVA | Distributed |
| PP | EAA | Distributed |
| HDPE | EEA | EEA |
| PP | EOC | EOC |
| HDPE | EVA | EVA |
| HDPE | PP | HDPE |
| HDPE | PS | HDPE |
| PP | HDPE | HDPE |
| iPP | HDPE | HDPE |
| HIPS | SIS | HIPS |
| PMMA | PP | Interface |
| HDPE | PMMA | Interface |
| PAN | PA6 | Interface |
| PP | PPMA | Interface |
| LDPE | PP | LDPE |
| LDPE | EVA | LDPE |
| LLDPE | EMA | LLDPE |
| LLDPE | NBR | NBR |
| PP | Novolac | Novolac |
| ABS | PA6 | PA6 |
| PA6 | PS | PA6 |
| PAN | PA6 | PA6 |
| PVDF | PA6 | PA6 |
| ABS | PA6 | PA6 |
| PMMA | PA6 | PA6 |
| PP | PA6 | PA6 |
| ABS | PC | PC |
| PVDF | PC | PC |
| PLA | PCL | PCL |
| PET | HDPE | PET |
| PLA | PPC | PPC |
| PP | PS | PS |

Even though their conductivity is very high, given the same concentration of the conductive filler as compared to the more traditional composites, the stability in time of known co-continuous composites may be lower on account of a possible migration of the filler itself from one phase or polymer to another phase or polymer and/or in the areas of junction between the two immiscible phases or polymers, in particular during the operating cycles of electrical supply and/or heating. Moreover, materials of this type are not normally stable if used for carrying high-density currents, roughly in the region of 0.01-0.2 A/cm$^2$.

On the other hand, a homogeneous distribution of the electrically conductive filler in all the phases or polymers of the matrix leads to a reduction of the crystalline nature of the composite, with consequent greater likelihood of migration of the particles of the electrically conductive filler, and hence lower stability of the system.

Moreover, co-continuous electrically conductive polymers are in general distinguished by a low thermal conductivity, with consequent low dissipation of heat.

AIM AND SUMMARY OF THE INVENTION

In its general terms, an aim of the present invention is to provide a polymeric composite material that overcomes the limits of the prior art and that presents an improved electrical conductivity and/or a PTC effect that is stable over time, in particular in the operating conditions, such as repeated heating cycles.

In accordance with a different object, an aim of the present invention is to provide a polymeric composite material distinguished by an improved thermal conductivity, preferably in combination with electrical conductivity or PTC effect.

An auxiliary aim of the invention is to indicate a methodology for obtaining such a composite material. Another auxiliary aim of the invention is to provide an electrical heater device, which may be in particular, but not exclusively, associated to or integrated in a component of a vehicle, based upon the use of a polymeric composite material that presents one or more of the characteristics referred to above.

One or more of the aforesaid aims are achieved, according to the present invention, by a polymeric composite, a production method, and an electrical heater that have the characteristics specified in the annexed claims. The claims form an integral part of the technical teaching provided herein in relation to the invention.

BRIEF DESCRIPTION OF THE DRAWINGS

The characteristics and advantages of the present invention will emerge clearly from the ensuing detailed description, with reference to the annexed drawings, which are provided purely by way of non-limiting example and in which:

FIG. 7 is a schematic perspective view of a heater device according to possible embodiments of the invention;

FIGS. 8 and 9 are a schematic perspective view and a sectioned perspective view, respectively, of a heater device according to possible embodiments of the invention, integrated in a component mounted in a tank;

DESCRIPTION OF PREFERRED EMBODIMENTS OF THE INVENTION

Figure 1:
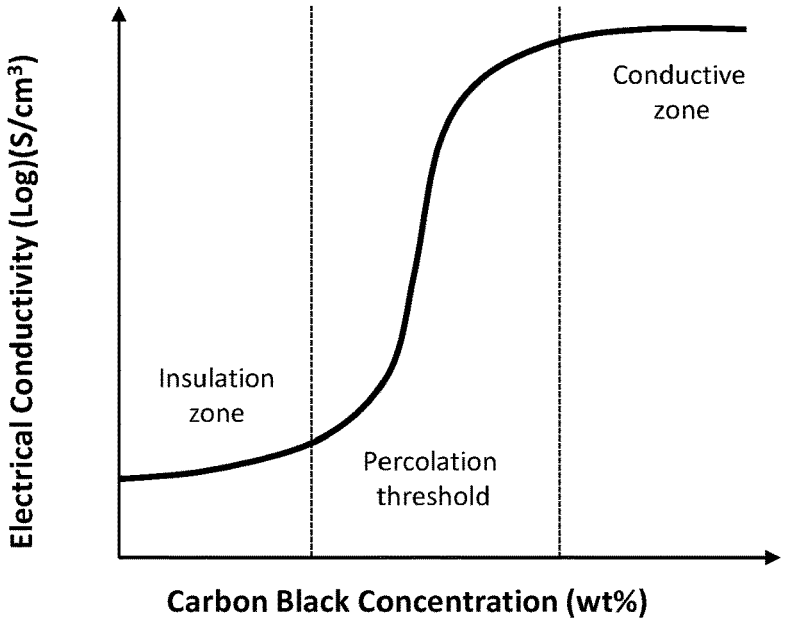
FIG. 1 is a graph aimed at expressing in schematic form the plot of the electrical conductivity in a generic composite, as a function of the concentration of its conductive filler.

Reference to "an embodiment" or "one embodiment" in the context of the present description is intended to indicate that a particular configuration, structure, or characteristic described in relation to the embodiment is comprised in at least one embodiment. Hence, phrases such as "in an embodiment" or "in one embodiment" and the like that may be present in various points of this description do not necessarily refer to one and the same embodiment. Moreover, particular conformations, structures, or characteristics defined within this description may be combined in any adequate way in one or more embodiments, even different from the ones represented. The numeric and spatial references (such as "upper", "lower", "top", "bottom", "up" and "down", etc.) are used herein merely for convenience and hence do not define the sphere of protection or the scope of the embodiments.

According to the invention, a composite material is provided, in particular of a mouldable type, which is at least in part electrically conductive, or has a positive-temperature-coefficient electrical resistance or PTC effect.

This composite, which belongs in particular to the family of co-continuous conductive polymers, has a matrix that comprises high-density polyethylene (HDPE), and polyoxymethylene (POM). In particular, HDPE and POM are mixed or blended with one another, keeping, however, the corresponding compositions substantially distinct. In preferential embodiments, the relative weight percentages of the two polymeric components are between 45 wt % and 55 wt %, where 100 wt % is the sum of the weight percentages of HDPE and POM. Hence, according to an inventive aspect, both the high-density polyethylene and the polyoxymethylene are in contact with, or adhere to the surface of, at least one electrode of an electrical heater that uses a composite according to the invention.

At least one part of the matrix, preferably its part consisting of HDPE, is filled with electrically conductive particles, in particular carbonaceous particles. The preferred filler is carbon black, but other carbonaceus conductive materials may be used, such as graphene or carbon nanotubes, or combinations of two or more of the materials referred to. In what follows, for practical reasons, reference will frequently be made just to carbon black, the filler possibly, however, being different and comprising any other at least in part electrically conductive material suited to the purpose. According to a further inventive aspect, then, in contact with, or adhering to, the surface of at least one electrode of an electrical heater that uses a composite according to the invention, both high-density polyethylene filled with electrically conductive particles, such as carbon black, and polyoxymethylene are present.

In various embodiments, the particles that provide the electrically conductive filler have micrometric or nanometric dimensions, of between 10 nm and 20 μm, preferably between 50 and 200 nm, possibly aggregated to form chains or branched aggregates having dimensions of between 1 μm and 20 μm. The particles preferentially have a substantially spheroidal geometry, but not excluded from the scope of the invention is the use of fillers that have another morphology, including ones having a high aspect ratio, such as the aforementioned case of carbon nanotubes.

Preferentially, the conductive filler, in particular carbon black, is previously added to the HDPE, in a weight percentage of between 10 wt % and 45 wt %, preferably between 16 wt % and 30 wt %, where 100 wt % is the sum of the weight percentages of the HDPE and the corresponding conductive filler. Consequently, in various embodiments, mixing of the conductive filler is carried out only in the HDPE, which is subsequently mixed with the other phase of the composite, i.e., the POM. Preferentially, the mixing of the HDPE with the filler is obtained by means of extrusion.

In this way, the electrically conductive filler is confined, or mostly confined, in just one of the immiscible polymers, preferably the HDPE. The phrase "confined, or mostly confined" is here meant to indicate that a minimal fraction of the conductive filler may also be present in at least one other of the immiscible polymers of the matrix, in particular following upon use of the composite, this considering the fact that, for example, in the course of the service life of the composite, or following upon the operating cycles of an electrical heater that comprises such composite, there may occur minor migrations of the electrically conductive filler from one polymer to the other.

In various embodiments, mixing between the HDPE already filled with the electrically conductive particles and the POM is obtained by means of extrusion.

Figure 2:
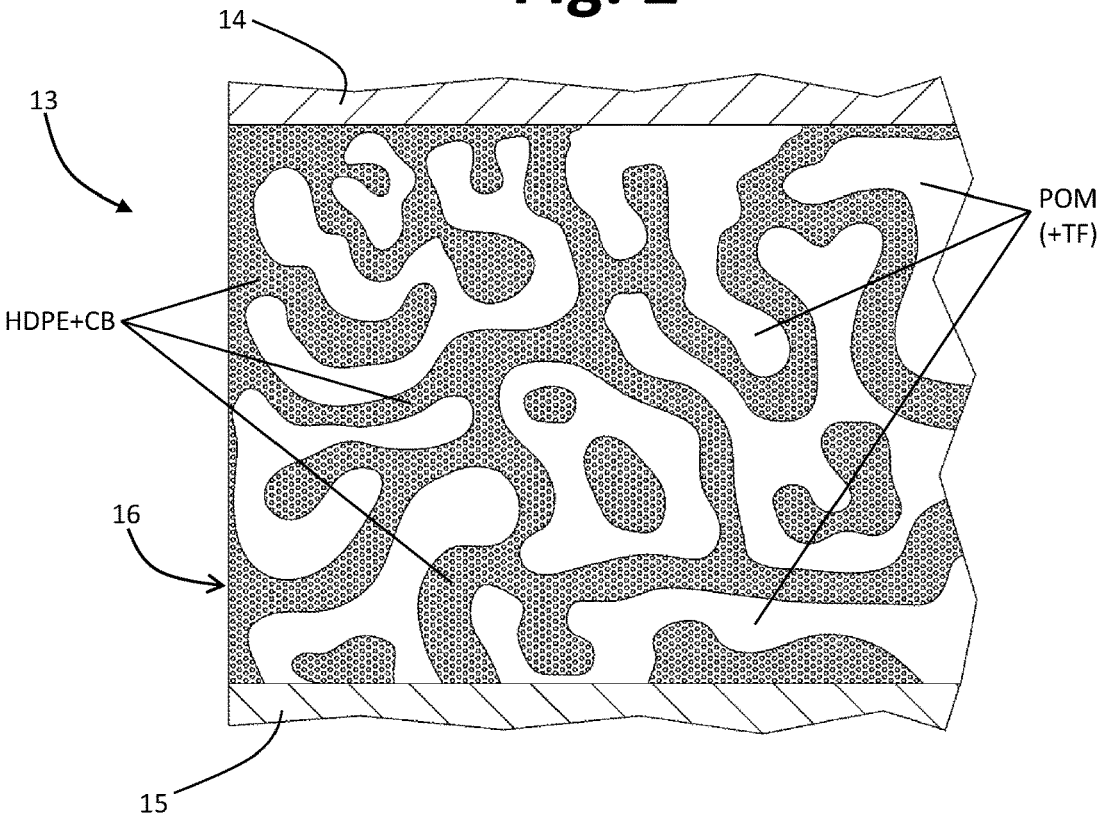
FIG. 2 is a partial and schematic cross section of a heater device according to possible embodiments of the invention.

FIG. 2 illustrates in purely schematic form a heater device 13 that uses a composite material according to the invention, designated as a whole by 16, set between two electrodes 14 and 15. The two immiscible polymers, the POM and the HDPE pre-filled with carbon black (CB), provide a three-dimensional structure, where the polymers intersect developing in all directions.

Table 2 below shows some examples of composites according to the invention, which are obtained with different weight percentages over the total of their components. In these examples, the conductive filler used is carbon black (CB). In the composites denoted as "type 1" a master batch with 18 wt % of carbon black was used (where 100 wt % is the sum of the weight percentages of HDPE and CB), whereas in the composites denoted as "type 2" a master batch with 30 wt % of carbon black was used (where 100 wt % is the sum of the weight percentages of HDPE and CB).

TABLE 2

Examples of composites according to the invention

| POM | HDPE | CB | HDPE + CB (wt %) | TYPE |
|---|---|---|---|---|
| 45 | 45.1 | 9.9 | 55 | 1 |
| 42 | 40.6 | 17.4 | 58 | 2 |
| 40.1 | 49.2 | 10.8 | 60 | 1 |
| 50 | 35 | 15 | 50 | 2 |

In general terms, a carbonaceous filler, for example carbon black, tends to localise in the amorphous domains of the polymers. In the presence of different polymers in one and the same composite, the carbon black tends to localise in some polymers rather than others (as illustrated in Table 1), it being understood that in each of them the prevalent localization is in the amorphous phase. This occurs also in the case of HDPE, where the carbonaceous filler is segregated in the amorphous phase, which represents a minority percentage over the total in the HDPE.

Localisation of the carbonaceous filler (carbon black is assumed) within a composite formed by two immiscible polymers depends upon the surface tension at the interfaces between the filler and the polymer A ($\gamma_{A_CB}$), between the filler and the polymer B ($\gamma_{B_CB}$), and between the polymer A and the polymer B ($\gamma_{A_B}$). In general terms, the distribution of the carbonaceous filler within a co-continuous composite can be estimated qualitatively from the wettability coefficient $\omega_{AB}$, defined as $$\omega_{AB} = \frac{\gamma_{B_CB} - \gamma_{A_CB}}{\gamma_{A_B}}$$

If $\omega_{AB}>1$, the carbonaceous filler is dispersed in A; if $\omega_{AB}<-1$, the carbonaceous filler is dispersed in B; if, instead, $1>\omega_{AB}>-1$, the carbonaceous filler is preferably localised at the interface (see again Table 1, for various examples of these situations).

In the methodology for obtaining the composite according to the invention, pre-mixing of the carbonaceous filler in one of the two polymers of the matrix enables modification of this type of dynamics during the extrusion step.

In the case of the invention, for example, even though POM has a greater affinity with carbon black than HDPE, it is possible to segregate the carbon black in the HDPE by means of the pre-mixing referred to above. On the other hand, in a final piece moulded using the composite according to the invention (for example, the mass 16 described hereinafter), the POM markedly limits migration of the carbon black within it in so far as it is markedly crystalline.

As compared to the prior art represented in Table 1, the use of POM to obtain HDPE-POM co-continuous composites presents various advantages.

In the first place, the high melting point of POM makes it possible, during extrusion of the composite, to maintain a better separation of the two HDPE and POM phases, reducing the possibility of migration of the carbonaceous filler in the POM (as has been said, contributing to this effect is the fact that the filler is preferentially previously mixed with just the HDPE). The higher melting point as compared to other known materials likewise makes it possible to obtain a more stable final structure: the PTC effect of the composite material forming the subject of the invention limits self-heating to a maximum temperature of approximately 120° C., which is much further from the melting point of POM (175-200° C.) than, for example, from that of PP or PMMA, which are traditionally used in the prior art.

POM moreover has a high crystallinity as compared to the materials used in the prior art, roughly comprised between 70% and 80%. This means that, in the co-continuous composite according to the invention, any migrations of filler from the HDPE to the POM are more unlikely, thereby preventing any loss of performance, for example due to heating and passage of electric current. The higher crystallinity of POM also renders the composite particularly resistant from the chemical standpoint and bestows high stability thereon. On the other hand, the crystallinity of HDPE is typically between 60% and 90%: in this way, a high concentration of the conductive filler in the amorphous domains is obtained, with corresponding high electrical conductivity.

In possible implementations of the method for obtaining the composites according to the invention, at least two types or master batches of HDPE, referred to hereinafter MB1 and MB2, are mixed together, one of which is filled with the carbon particles aimed at ensuring electrical conductivity, i.e., it is filled at a high or higher concentration, and the other is filled at a low or lower concentration, for example with particles aimed at facilitating nucleation, or else is without fillers. Hence, according to another inventive aspect, present in contact with, or adhering to, the surface of at least one electrode of an electrical heater that uses a composite according to the invention are a first high-density polyethylene filled with a first percentage of electrically conductive particles, a second high-density polyethylene without fillers, or filled with a second percentage of electrically conductive particles, and polyoxymethylene.

Also in these implementations, the weight percentage of the POM remains between 45 wt % and 55 wt % over the total weight of the matrix, and the rest is constituted by the HDPE obtained from the two master batches MB1 and MB2. The relative concentrations of the master batches MB1 and MB2 may vary within a wide range according to the specific concentrations of conductive and/or nucleating filler, where one of the two can assume a relative concentration of between 5 wt % and 95 wt %, preferably between 20 wt % and 50 wt %.

Figure 15:
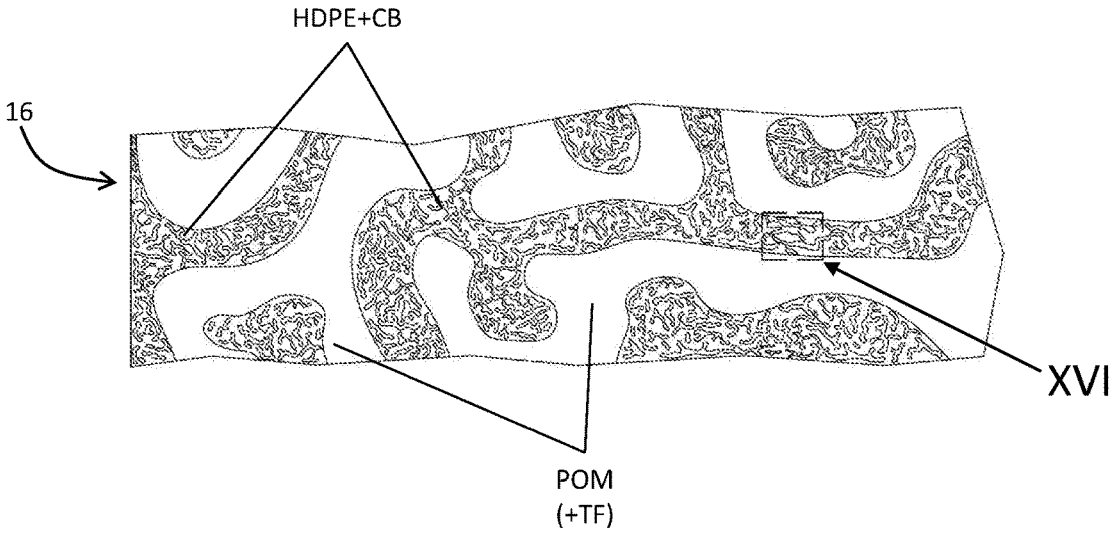
FIG. 15 is a partial and schematic cross-sectional view of a portion of a composite according to further possible embodiments of the invention.
Figure 16:
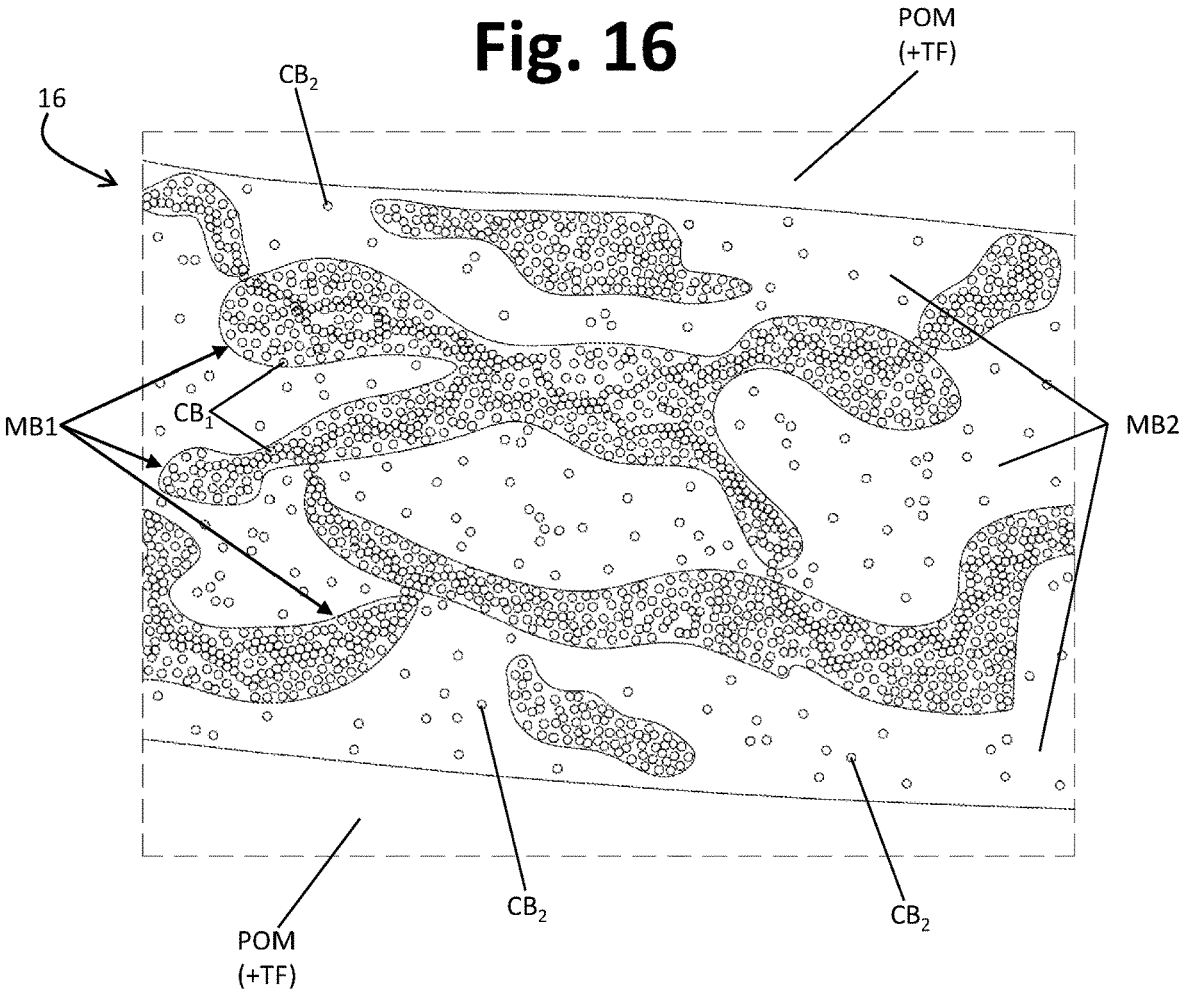
FIG. 16 illustrates the detail XVI of FIG. 15 at an enlarged scale.

Preferentially, in these implementations, the at least two master batches MB1 and MB2 are previously each mixed with the corresponding filler, preferably via extrusion. Alternatively, as has been mentioned, one of the two master batches might not be filled with electrically conductive fillers. The two master batches MB1 and MB2, with different fillers, or one with fillers and the other without, are then mixed with one another, for example via extrusion. The mixture resulting from the two master batches MB1 and MB2 is in turn mixed with the POM, preferably via extrusion. The POM may possibly be mixed in a single step together with the two master batches MB1 and MB2. Possibly, before mixing, the POM may be supplemented with a thermally conductive filler, in particular of a substantially electrically insulating type. In FIGS. 2, 15, and 16, the optional presence of such a thermally conductive filler has been designated by (+TF). Hence, according to another inventive aspect, present in contact with, or adhering to, the surface of at least one electrode of an electrical heater that uses a composite according to the invention are a first high-density polyethylene, filled with a first percentage of electrically conductive particles, a second high-density polyethylene without fillers, or filled with a second percentage of electrically conductive particles, and polyoxymethylene, filled with thermally conductive particles.

In a possible implementation, the two master batches MB1 and MB2 are prepared in the following way:

- the master batch MB1 is filled with electrically conductive particles of a material, such as carbon black, in a relatively high concentration, of between 10 wt % and 45 wt %, preferably between 16 wt % and 30 wt %;
- the master batch MB2 is possibly filled with electrically conductive particles of a material at a lower concentration in order to facilitate nucleation; this filler, for example graphene, or once again carbon black, or other carbonaceous micro-particles or nano-particles, may range between 0 wt % and 20 wt %; the concentration of the master batch MB1 should be preferably higher by at least 5% than that of the master batch MB2.

An embodiment of this type is exemplified in FIGS. 15-16. Visible in FIG. 15 is a portion of a composite 16, with the POM and the HDPE phase (constituted by the two original master batches MB1 and MB2) filled with the conductive particles CB.

From FIG. 16, which illustrates the detail XVI of FIG. 15, it may be noted how the HDPE fraction with higher filler concentration, denoted in the figure as MB1 (in so far as it substantially corresponds to the original master batch MB1), is substantially confined within the HDPE fraction, with a lower concentration of electrically conductive filler, denoted in the figure as MB2 (in so far as it substantially corresponds to the original master batch MB2). Denoted by $CB_1$ and $CB_2$ are some of the particles of the fillers present in the fractions MB1 and MB2, respectively.

Solutions of this type enable considerable reduction of possible migration of filler from the HDPE to the POM, or at least delay it considerably during the service life of the composite. As may be appreciated, in fact, in solutions of this type, the fraction MB1 of the HDPE with higher concentration of filler $CB_1$ is surrounded by the fraction MB2 of the HDPE with lower concentration of filler $CB_2$, or, expressed in other words, set between the POM and at least one part of the fraction MB1 is the fraction MB2. Possible migration of the conductive filler from the HDPE to the POM is hence markedly limited, both because the particles $CB_1$ of the fraction MB1 are hindered from migrating directly into the POM and because the concentration of particles $CB_2$ of the fraction MB2 is reduced so that any possible direct migration of one of them to the POM is in any case limited.

Even though not excluded from the scope of the invention are implementations in which one (MB2) of the two master batches MB1 and MB2 is not filled with electrically conductive particles, it is in any case preferable for both of them to be filled, albeit at different concentrations, as mentioned above. The presence of electrically conductive filler at a lower concentration within one of the two fractions (here MB2) in fact reduces the tendency of the filler to migrate for the other fraction (MB1) as compared, for example, to a situation where one of the two fractions consists of non-filled HDPE.

To clarify this aspect better, accelerated-ageing tests were conducted for three different composites 16 according to the invention, as appears from Table 3 below.

TABLE 3

| Tests on composites according to the invention | | | | | |
|---|---|---|---|---|---|
| | POM | HDPE + 18 wt % CB | HDPE + 27 wt % CB | HDPE + 23 wt % CB | HDPE |
| Composite 1 | 47 wt % | 43 wt % | 0 | 10 wt % | 0 |
| Composite 2 | 46 wt % | 0 | 39 wt % | 0 | 15 wt % |
| Composite 3 | 40 wt % | 60 wt % | 0 | 0 | 0 |

As may be noted, Composite 1 included the POM phase and a phase constituted by two master batches or fractions of HDPE both filled with carbon black, Composite 2 included the POM phase and a phase constituted by a master batch or a fraction of HDPE filled with carbon black and a master batch or a fraction of HDPE without any filler, and Composite 3 included a POM phase and an HDPE phase constituted by a single master batch filled with carbon black.

Figure 3:
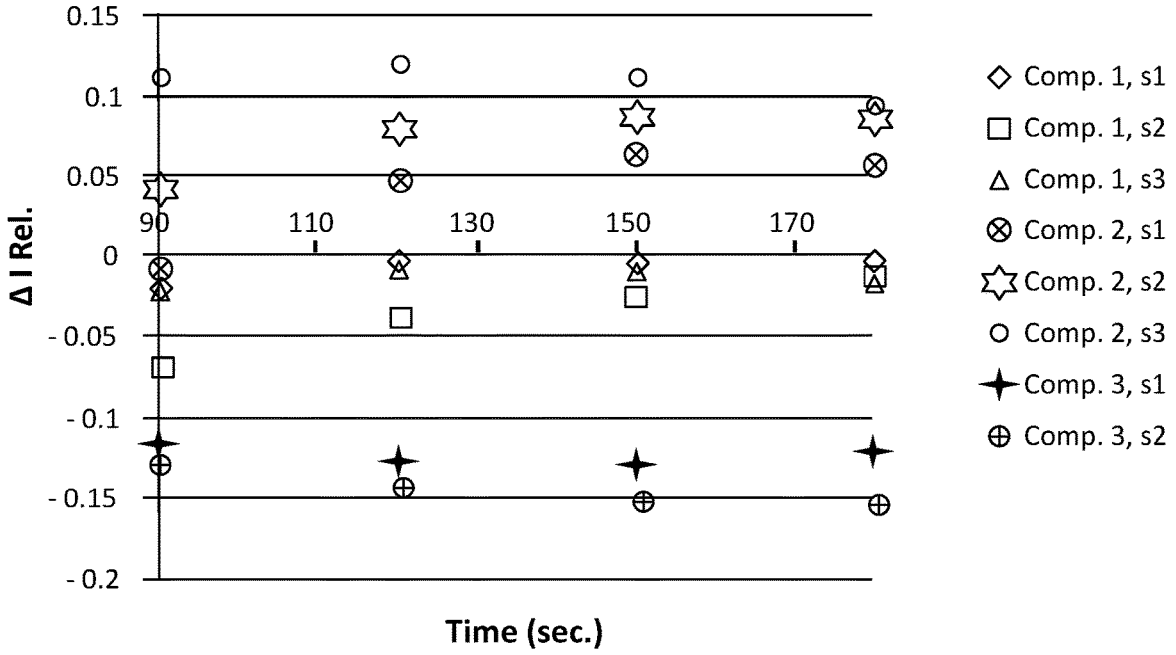
FIG. 3 is a graph that expresses in schematic form the result, in terms of relative variation of electric current as a function of time during an ON cycle at room temperature, of different samples of composites according to embodiments of the invention, following upon accelerated ageing.

The total carbon black filler CB was in all three composites very similar, in an amount of between 10 wt % and 10.8 wt %, i.e., at the limits of repeatability by means of extrusion techniques, so as to make it possible to observe the specific effect of a different distribution of the carbonaceous filler in different parts of the composite on the stability thereof. To obtain accelerated ageing, the samples were kept at 125° C. for 10 minutes. The graph of FIG. 3 shows the relative variation of current in time over the current measured on the new (i.e., non-aged) samples, according to the formula:

$$\Delta I\ Rel = \frac{(I(t)\text{new} - I(t)\text{aged})}{I(t)\text{new}}$$

The value of current is a function of time in so far as the PTC effect leads to a reduction of the current in time. The graph represents the first three minutes after turning-on, at room temperature of 21° C., after which time it may to a good approximation be assumed that a steady-state current has been reached due to setting-up of the dynamic thermal equilibrium with the surrounding environment. The graph shows the values for three samples (s1-s3) of Composite 1, three samples (s1-s3) of Composite 2, and two samples (s1-s2) of Composite 3.

In the case of Composite 1, the variation of the steady-state current of the aged samples with respect to the new samples is lower than 2%, whereas, in the case of Composite 2, there is a reduction in the steady-state current of between 5% and 10%. Composite 3 presents the most critical type of drift in so far as it shows an increase in the steady-state current of between 12% and 15%. The effect may be explained with a migration of the filler CB at the interface with the POM (it is known that segregation at the interface of two phases leads to an extremely high relative concentration and corresponding high conductivity). The phenomenon could hence proceed in time up to loss of the PTC effect.

It should be noted that the effect of contrast to migration of filler can be obtained using a master batch MB2 even without filler. As has been said, however, the presence of a minimum amount of filler also in the master batch MB2 presents the advantage of facilitating the nucleation and reducing the difference in the relative concentrations, rendering less likely migration from one batch to the other (by analogy consider what occurs in the phenomenon of osmosis). As may be noted from the graph of FIG. 3, in fact, use of non-filled HDPE (Composite 2) leads to a reduction of the steady-state current, thus preventing any dangerous drift to increasingly higher currents, but the resulting composite is in any case less stable than the mixture of two master batches both containing fillers. The carbonaceous filler in fact migrates in part from the master batch with high concentration to the master batch without any filler, with consequent dilution thereof, reduction of the conductivity, and corresponding loss of performance.

As has been mentioned, in various embodiments, the POM is previously supplemented with a thermally conductive filler TF. Preferentially, the material of the particles of the thermally conductive filler is a substantially electrically insulating material, such as boron nitride (BN). The preferred use of a thermally conductive filler TF, which, however, is substantially insulating from the electrical standpoint, is aimed at preventing or reducing any possible alteration of the electrical performance of the composite, such as the PTC effect, albeit improving thermal dissipation of the composite itself. Preferably, the thermally conductive filler TF comprises a material having a value of thermal conductivity k higher than 200 W/(m·K) at 25° C. A preferred material in this sense is, for example, boron nitride (NB). It should be noted that the thermal conductivity k at 25° C. of the two preferential fillers exemplified, i.e., the electrically conductive filler CB and the thermally conductive filler TF, is approximately 6 to 174 W/(m·K) for the carbon black and 250 to 300 W/(m·K) for the boron nitride.

Hence, according to another inventive aspect, present in contact with, or adhering to, the surface of at least one electrode of a heater that uses a composite according to the invention are both high-density polyethylene (HDPE) filled with electrically conductive particles and polyoxymethylene filled with thermally conductive particles.

The POM is preferentially supplemented with the corresponding thermally conductive filler, for example via extrusion, prior to mixing or extrusion with the HDPE already supplemented with the corresponding electrically conductive filler. In this way, the thermally conductive filler is confined, or mostly confined, in one of the immiscible polymers, i.e., the POM, different from the one in which the electrically conductive filler is confined, or mostly confined, i.e., the HDPE. What has been mentioned previously in relation to the phrase "confined, or mostly confined" applies also in the case of the thermally conductive filler.

The thermally conductive filler may be in a concentration of between 5 wt % and 70 wt %, preferably between 15 wt % and 30 wt % (where 100 wt % is the sum of the weight percentages of the POM and the thermally conductive filler). The thermally conductive filler enables an increase in the thermal conductivity (i.e., reduction in thermal resistance) of the composite and thereby an increase of the dissipation of the heat towards the outer surfaces and/or the metal electrodes (14, 16, FIG. 2) that are responsible for a major part of the thermal exchange with the external environment (i.e., towards a generic medium to be re-heated, such as a liquid or an aeriform fluid). Such a thermally conductive filler hence enables improvement of the performance of a PTC heater, increasing thermal conductivity and thermal dissipation thereof. The preferred thermally conductive filler comprises particles of boron nitride (BN), but other types of filler are not excluded, such as talc, aluminium nitride, aluminium oxide, and mixtures of two or more of these materials.

As has been seen, the final polymeric composite obtained according to the invention is a co-continuous structure, where the HDPE phase is in turn divided into amorphous domains containing the majority of the electrically conductive filler and domains with a high crystallinity, which are electrically insulating or in any case have a lower electrical conductivity. According to the invention, the use of the POM is envisaged also in order to bestow a higher structural strength upon the material, i.e., upon the heater component that integrates it, enabling operation also at a temperature higher than the one that can be achieved with just the HDPE; there is moreover guaranteed an efficient transport of heat.

The passage of electric current through the composite leads to an increase in temperature: the thermal expansion moves the conductive particles away from one another, thus causing the PTC effect. The phenomenon is already present at a low temperature, but becomes particularly important for temperatures higher than 60° C., reaching a maximum of electrical resistance at temperatures of between 110° C. and 120° C.

Figure 4:
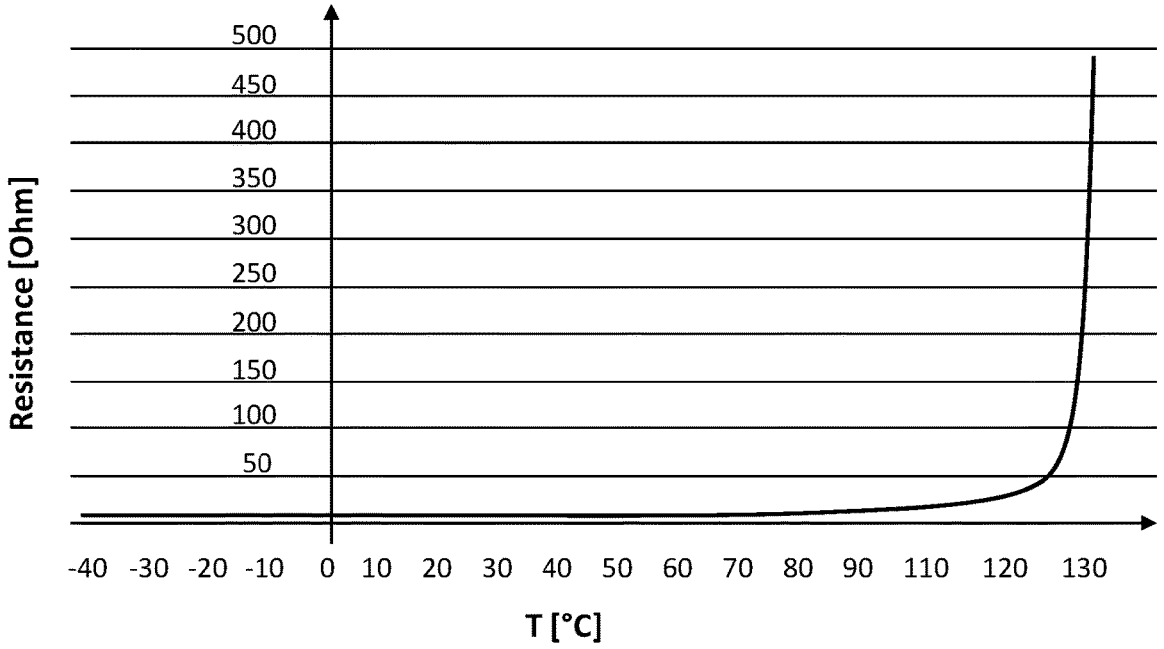
FIG. 4 is a graph that expresses in schematic form the plot of the electrical resistance as a function of temperature for a sample of a composite according to embodiments of the invention.

FIG. 4 presents the plot of the resistance (measured in ohms) as a function of the temperature (T) for a sample of a composite according to the invention. The measurements appearing in FIG. 3 were made by applying a voltage of 1 V, via two electrodes, to a sample of composite shaped like a parallelepiped, having a thickness of 1.8 mm and major faces with area of (100×100) $mm^2$. The electrodes completely coat the major faces. The sample was obtained with Composite 1 of Table 3.

Figure 5:
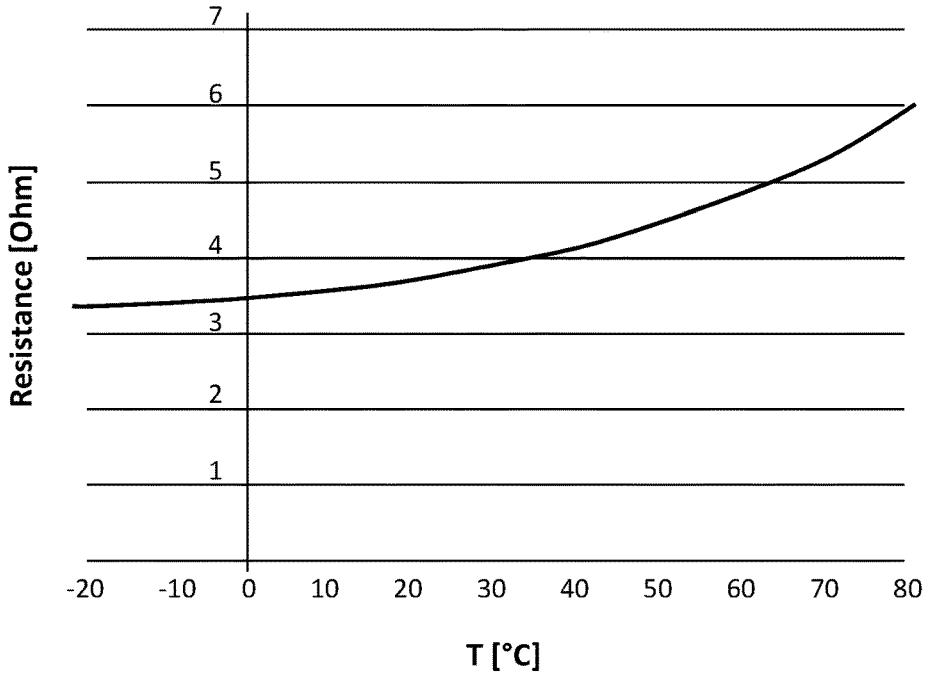
FIG. 5 is a portion at a larger scale of the graph of FIG. 4.

Starting from a temperature of 110° C., the increase in resistance is very pronounced, but it may be noted how the increase in resistance is already present at lower temperatures: this may be noted from FIG. 5, which presents a stretch of the curve of FIG. 3 between −20° C. and 8° C. The progressive increase in resistance of the sample, already starting from relatively low temperatures, leads to a thermoregulation of the heater that depends upon the conditions of dissipation, even at a temperature lower than 120° C. that is reached only in conditions of very limited thermal dissipation.

Figure 6:
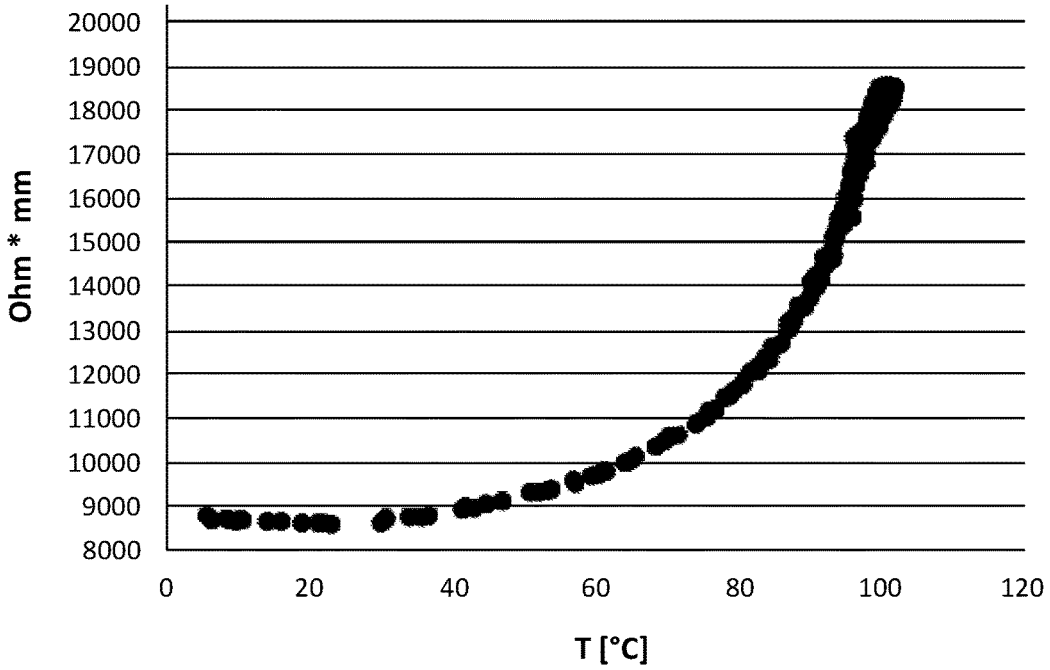
FIG. 6 is a graph that expresses in schematic form the average plot of the resistivity of a sample of a composite according to embodiments of the invention, subjected to a series of cycles of electrical supply.

FIG. 6 shows the plot of the resistivity of the sample supplied with a constant voltage of 13.5 V, applied for 30 minutes, with a distance between the facing electrodes of 2 mm, with the composite set in between. The sample was characterized in air at 5° C.

The curve shown in Figure is the result of superposition of the curves of the last fifty ON/OFF cycles of the sample examined, which was subjected in all to 700 cycles (30 min ON, 30 min OFF). It is very important to emphasise that, between the start and the end of the test (i.e., at cycle "1" and at cycle "700"), the curve does not undergo appreciable variations. At an ambient temperature of 5° C., the sample reached equilibrium at around 100° C. The material did not reach temperatures higher than the temperature of 120° C. due to self-heating induced by electric current.

A heater device that includes the composite with PTC effect according to the invention has at least one heating element, which basically constitutes a positive-temperature-coefficient resistor.

In various embodiments, the heater device is configured as a stand-alone component, which comprises one or more heating elements, where the heating element or each heating element comprises two electrodes, set between which is a mass of the composite with PTC effect according to the invention, in particular a three-dimensional, preferably substantially parallelepipedal, mass. FIG. 7 illustrates, for example, the case of a heater device 13 that includes a single heating element 13*a*, formed by two electrodes 14 and 15, between which a mass 16 of the composite with PTC effect has been inserted or moulded.

The heating element 13*a* (or each heating element) is associated, for example fixed, to a supporting body that may belong to a more complex system, such as a duct of a system for heating air or a liquid, or may belong to a tank, or to a component of a tank for containing a liquid that has to be heated. In other embodiments, the heater device, again configured as a stand-alone component that comprises one or more heating elements as defined above, has a supporting body of its own, which is in turn associated to a more complex system. In these embodiments, the heating element (or each heating element) may, for example, be mounted on the aforesaid supporting body, or else a supporting body made of plastic material may be overmoulded directly on the heating element (or each heating element) of the heater device. In other embodiments still, the heater device or a heating element thereof is integrated in a component prearranged for performing also functions different from heating of a generic medium, in which case the body of the component is exploited to provide also the supporting body of the heater device. In embodiments of this type, for example, the supporting body of the component in question may be overmoulded on the heating element or each heating element of the heater device. In the sequel of the present description reference will be made for simplicity to the latter case.

Figure 9:
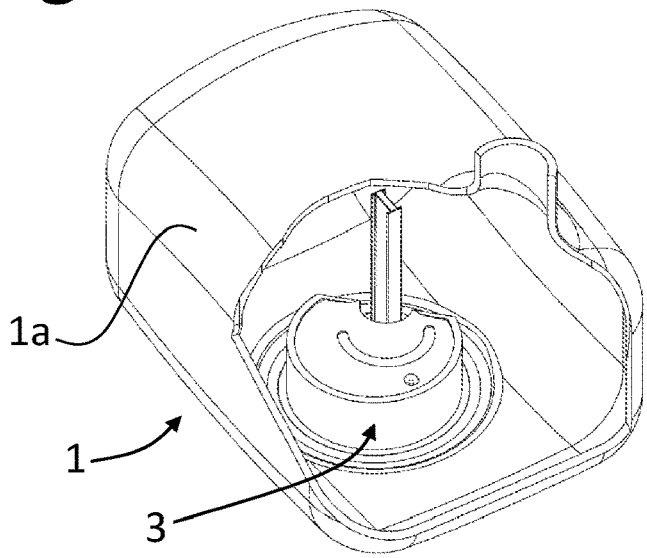

With reference to FIGS. 8 and 9, designated as a whole by 1 is a tank for vehicles. This tank may be designed to contain a liquid for a vehicle, in particular a liquid subject to freezing or the performance or characteristics of which may be altered at low temperatures, such as a fuel, or water (also for anti-detonant-injection—ADI—purposes), or a solution containing water, or an additive, or a reducing agent, or a washing solution, or a lubricant.

In what follows, it is to be assumed that the above tank is designed to contain an additive, or a reducing agent, and forms part of a system for the treatment of exhaust gases of an internal-combustion engine, represented as a whole by the block 2. In various embodiments, the treatment system 2 is of an SCR type, used for abatement of emissions of nitrogen oxides and particulate, in particular in motor vehicles with diesel engines. The aforesaid reducing agent may be urea in a distilled-water solution, such as the one commercially known under the name AdBlue™. The tank 1 and/or the corresponding heater according to the invention could in any case be used for other purposes and/or in sectors different from the automotive sector, and be designed for a different liquid that requires heating, as already referred to above.

The main body 1*a* of the tank 1 may be made of any material, preferably a material that is chemically resistant to the substance contained, for example metal, or may be made of a suitable plastic material, according to known technique, such as a high-density polyethylene (PEHD). As visible in FIG. 9, the body 1*a* of the tank has an opening (not indicated) where a component 3, which integrates a heater device according to possible embodiments of the invention, is sealingly mounted. In the example, the aforesaid opening is provided in a lower part of the tank 1, but this position should not be understood as essential. In various preferred embodiments, such as the ones represented herein, the component 3 has a body shaped to enable fluid-tight fixing to the tank, i.e., occlusion of the aforesaid opening of the tank. This body may be sealingly fixed at the aforesaid opening according to modalities in themselves known: for instance, with reference to the example illustrated, the body of the component 3 is preferably removably mounted via an engagement system including a corresponding fixing ringnut 4, possibly, however, being fixed in another way, such as welding or with threaded means.

In various embodiments, the component 3 fulfils only heating functions, and its body hence provides a supporting and/or protection casing for the heater device. In other embodiments, such as the one exemplified, the component 3 is conceived for performing a plurality of functions, amongst which that of heating, and integrates for this purpose a heater device according to the invention.

Figure 10:
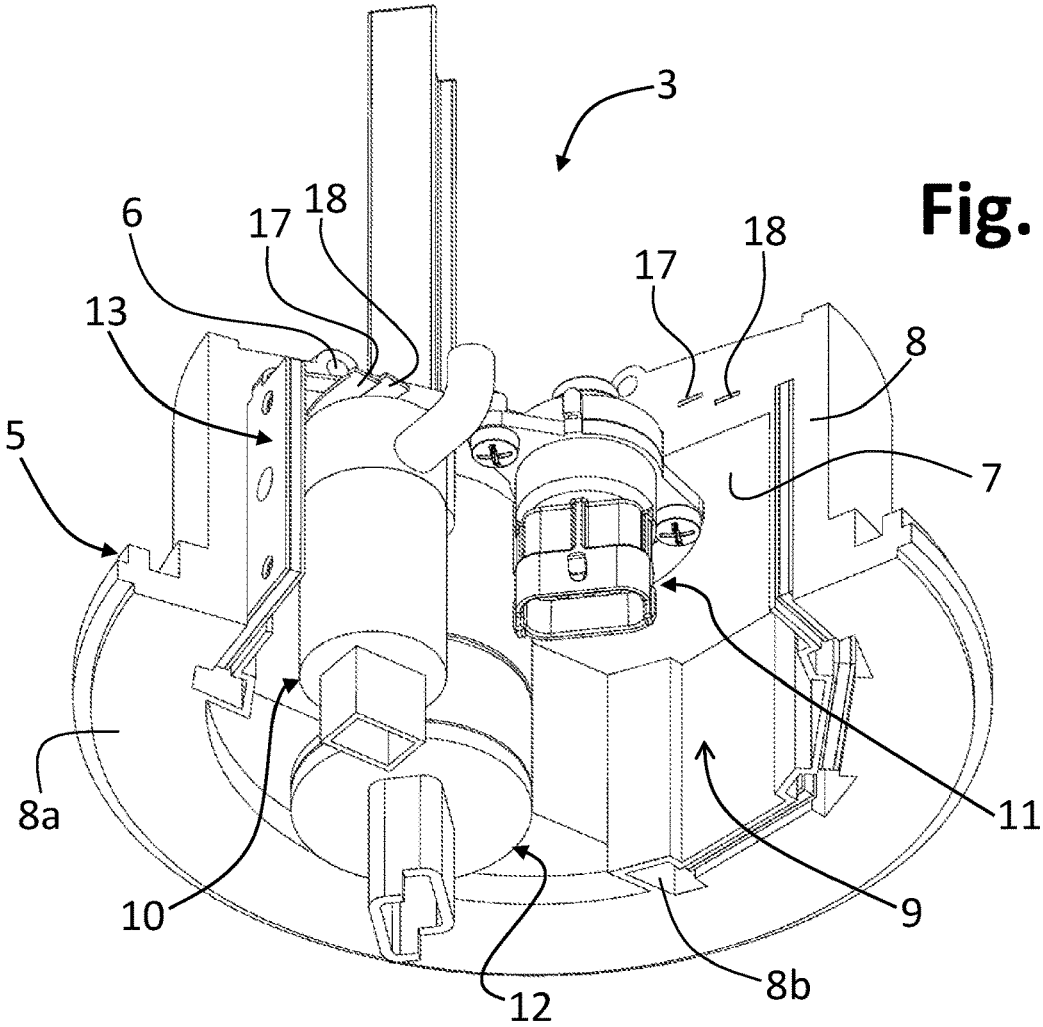
FIG. 10 is a sectioned perspective view of a component of FIGS. 8-9.

With reference also to FIG. 10, in various embodiments, the body of the component 3, designated by 5, can define at least one passage 6, through which the reducing agent may be supplied to the system 2.

In various embodiments, the body 5 of the component 3 comprises a bottom wall 7 and a substantially tubular peripheral wall 8 in order to define a cavity 9. In the example represented, at the end of the wall 8 opposite to the wall 7 a flange 8*a* is defined, which projects outwards and forms part of the system for engagement of the component 3 to the tank 1.

Preferentially, defined in the bottom wall 7 is at least in part a passage 6 that enables drawing-off of the reducing agent. In various embodiments, for this purpose, associated to the body 5 is a pump (designated by 10) preferably set in the cavity 9. In various embodiments, there may also be associated to the component 3 one or more further functional devices, for example for detecting characteristics of the fluid contained in the tank 1. In possible embodiments, associated to the component 3 are sensor means, such as one or more from among a level sensor, a temperature sensor, and a pressure sensor. With reference to the case illustrated in FIG. 10, housed within the cavity 9 of the body 5 are a pressure sensor 11 and, at least partially, a sensor 12 for detection of the level of the reducing agent in the tank 1. The pump 10 and the sensors 11, 12, or other functional devices, such as a filter, may be obtained according to any known technique, as likewise the modalities of installation thereof on the body 5. Moreover not excluded from the scope of the invention is the case where the component 3 is provided—either in addition or as an alternative—with sensor means different from the ones referred to, as well as with further active components of the system 2. Given that the reducing agent that is to be contained in the tank 1 is subject to freezing, when the tank itself is exposed to low temperatures, incorporated in the body 5 of the component 3 is a heater device according to the invention, designated as a whole by 13 in FIG. 10.

Figure 11:
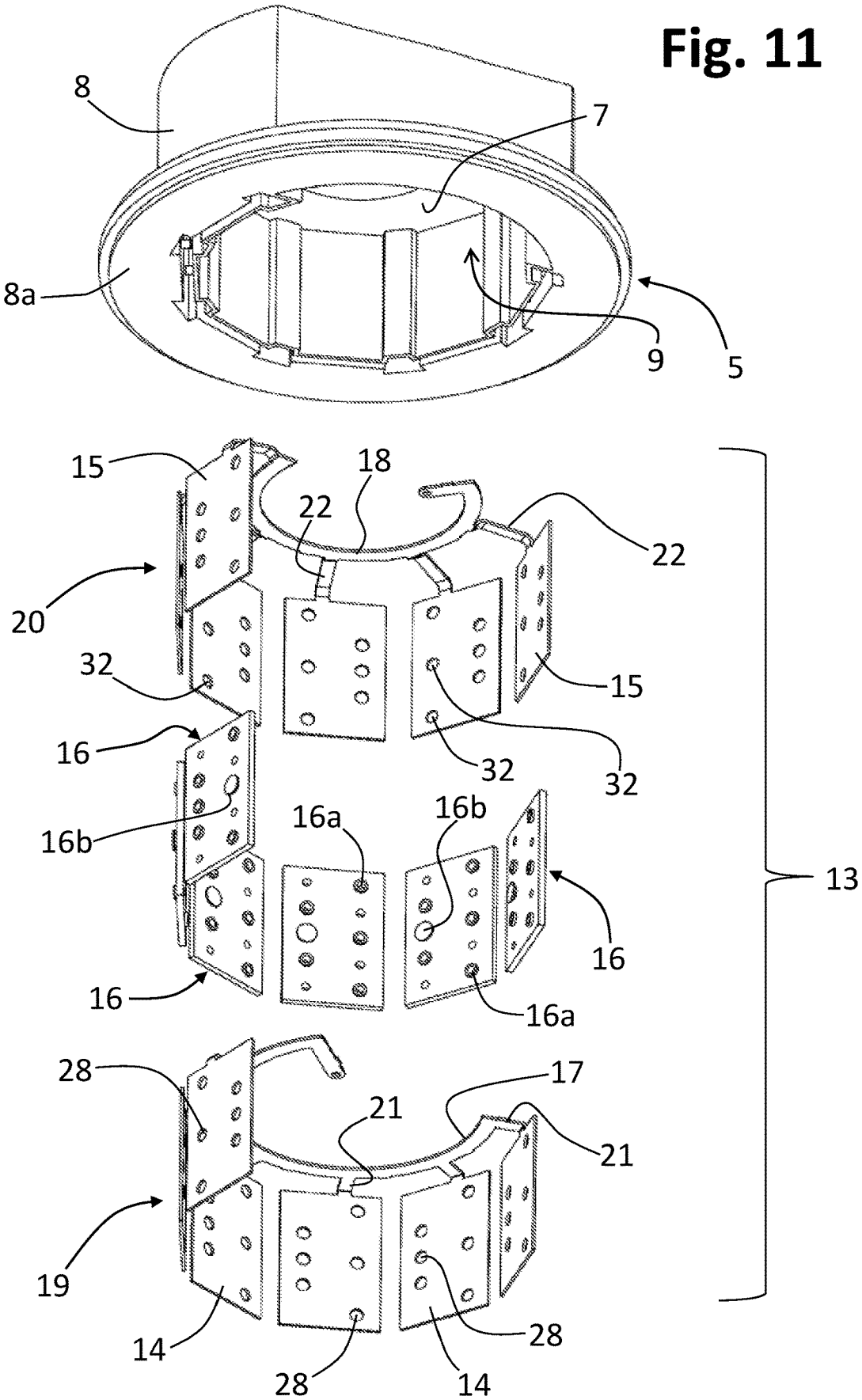
FIG. 11 is an exploded schematic view of a heater device according to other possible embodiments of the invention.

As has already been mentioned, the above heater device 13 may comprise a single heating element 13*a*, as exemplified in FIG. 7, or else a plurality of heating elements 13*a*, as in the case of FIGS. 11-14. With reference, for example, to FIG. 11, and as has already been mentioned, each heating element comprises a first electrode 14 and a second electrode 15, as well as a respective mass of the composite 16 with PTC effect, set at least in part between the two electrodes 14 and 15. The electrodes 14 and 15 are preferably of a laminar type, or plate type, or grid type, or comb type.

Preferentially, set in the area between the two facing electrodes 14 and 15 is a prevalent part of the corresponding mass of composite 16. In various embodiments, a smaller or small part of the mass of composite 16 is located also at the opposite or outer faces of the electrodes 14 and 15, preferably to perform functions of fixing and/or positioning of the electrodes 14 and 15.

In the case of FIGS. 11-14, where the heater device 13 includes a number of heating elements 13*a*, common conductive elements 17 and 18 are preferentially provided, connected in parallel to which are the various electrodes 14 and 15, respectively. The electrodes 14 may be made of a single piece with the corresponding common conductive element 17, thereby providing a first shaped metal lamina 19, whereas the electrodes 15 may be made of a single piece with the corresponding common conductive element 18, thereby providing a second shaped metal lamina 20. Preferentially, each of the laminas 19 and 20 also defines respective connection portions, designated by 21 and 22, respectively, which extend between the corresponding common conductive element 17 or 18 and the corresponding laminar electrodes 14 or 15.

According to alternative embodiments, the electrodes 14 and/or 15 are obtained individually, even stamped or machined using a technique or with a shape different from what has been exemplified, and connected together via respective common electrical conductors configured as added elements, such as relatively stiff metal conductors or of conductors the so-called busbar type. In these embodiments, the aforesaid added common conductors may be mechanically and electrically connected to the electrodes 14, 15 via specific operations (for example, welding, and/or riveting, and/or mutual fixing via mechanical deformation of at least one of the parts in question). Once again for the case of electrodes configured as parts that are distinct from the corresponding common conductive elements, the latter may be made of an electrically conductive polymeric material, for example overmoulded at least in part on the electrodes themselves.

Figure 12:
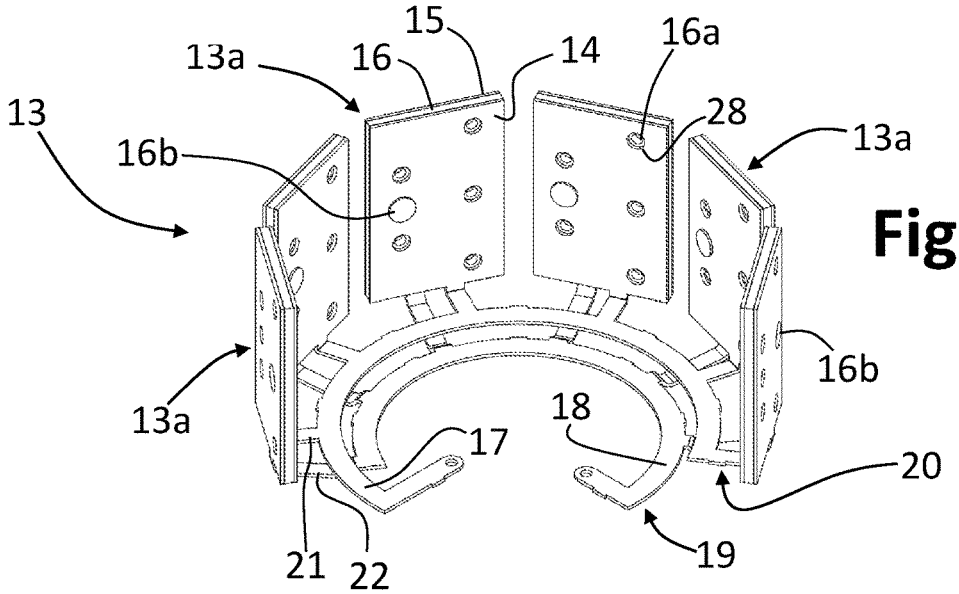
FIGS. 12, 13, and 14 are a schematic perspective view, a schematic top plan view, and a schematic view in side elevation, respectively, of a heater device according to possible embodiments of the invention.
Figure 13:
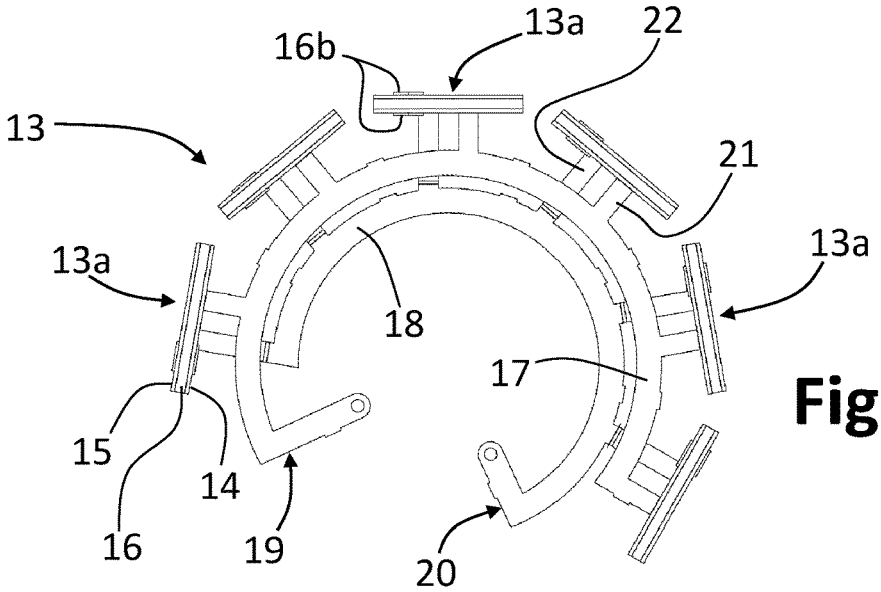
Figure 14:
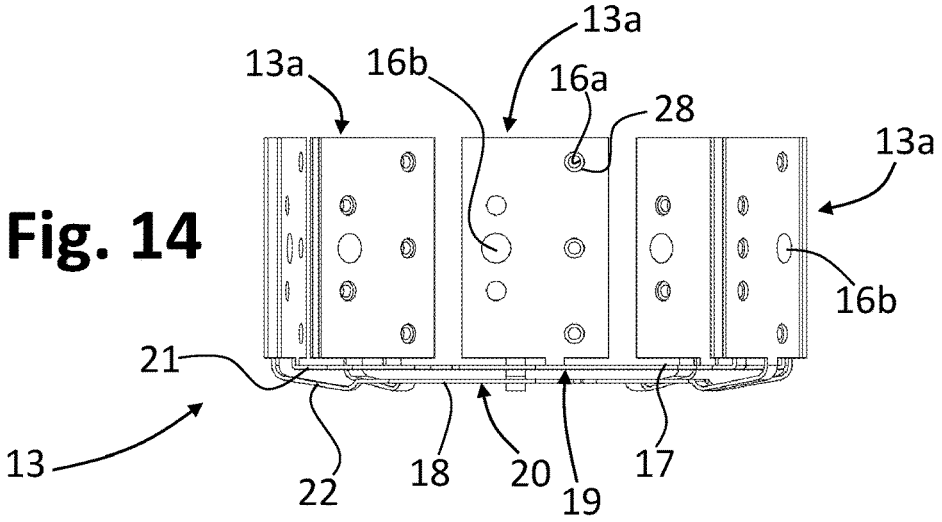

After the laminas 19 and 20 have been obtained, they can be introduced into a mould, in order to enable overmoulding of the composite 16 between the various pairs of electrodes 14, 15. The laminas 19 and 20 are positioned in the mould referred to above at a predefined distance, which defines the thickness of the composite 16 moulded between the electrodes 14 and 15. After solidification of the composite injected, the mould is opened, and the heater 13, which is by now defined, can be extracted. After possible finishing processes, for example processes of bending of the heating elements 13*a* with respect to the common conductors 17, 18, the heater is basically as represented in FIGS. 12-14.

In the case of the embodiment of FIGS. 8-14, the heater 13 may then be set in a further mould, used for forming the body 5 of the component 3, which here also forms the body of the heater device itself. In the example, following upon the operation of overmoulding of the body 5, the heating elements 13*a* (i.e., the corresponding electrodes 14 and 15) are distributed and set at a distance from one another in the perimetral direction of the wall 8.

Hence, in effect the body 5 is made of plastic material, in particular of an electrically insulating type and preferably of a thermally conductive type, overmoulded on the two shaped laminas 19 and 20 illustrated in FIG. 10, with the PTC-effect composite 16 set in between.

The heating elements 13*a* of the heater 13 are hence embedded to a prevalent extent in the overmoulded plastic material that forms a first wall of the body 5, here represented by the peripheral wall 8. In preferred embodiments, like the one represented, the heating elements 13*a* are partially embedded also in the overmoulded plastic material that forms a second wall of the body 5, here represented by the bottom wall 7. Preferentially, at least one of the two common conductive elements 17 and 18, or preferably both, is/are embedded at least in part in the overmoulded plastic material that forms the aforesaid second wall or bottom wall 7. On the other hand, in embodiments (not represented), the conductive elements, or at least one of them, could be embedded in the material that forms the wall 8. In principle, moreover, the heating elements 13*a* could also be embedded only in the material that forms the wall 8. Two or more heating elements 13*a* of the heater 13 could also be joined to one another by the composite material 16 with PTC effect, at least in part set between respective electrodes 14 and 15. In this case, the aforesaid overmoulded electrically insulating material could also be absent.

Of course, the characteristics described above in relation to the heated elements 13*a* apply also to the case of a heater device 13 including a single heating element, as in the case of FIG. 7.

The invention may also be used in heater devices where the composite with PTC effect is not overmoulded on corresponding electrodes, or in heating elements where a mass of the composite is moulded separately, for example with a predefined geometry, and subsequently applied to said mass are the corresponding electrical-supply electrodes.

From the foregoing description the characteristics of the present invention emerge clearly, as likewise do its advantages. It is clear that numerous variations to the module described by way of example are possible for the person skilled in the branch, without thereby departing from the scope of the invention as defined by the ensuing claims.

The solution previously referred to, regarding the combination of at least two immiscible polymers, of which one is supplemented with an electrically conductive filler and the other is supplemented with a thermally conductive filler, is to be understood as forming the subject of autonomous protection, even in the case where the aforesaid immiscible materials are different from HDPE and POM.

The invention claimed is:

1. A co-continuous polymeric composite having PTC effect, having a matrix that comprises at least two immiscible polymers, and at least one electrically conductive filler in the matrix, wherein at least one of said immiscible polymers is high-density polyethylene, wherein at least another one of said immiscible polymers is polyoxymethylene, wherein the high-density polyethylene comprises a first fraction having a higher concentration of electrically conductive filler, and a second fraction free of electrically conductive filler or having a lower concentration of electrically conductive filler, the first fraction being mixed with the second fraction and/or at least partially confined within the second fraction.

2. The composite according to claim 1, wherein high-density polyethylene and polyoxymethylene are in relative weight percentages of between 45 wt % and 55 wt %, where 100 wt % is the sum of the weight percentages of the high-density polyethylene and of the polyoxymethylene.

3. The composite according to claim 1, wherein the electrically conductive filler is confined, or mostly confined, in the high-density polyethylene, in a weight percentage of between 10 wt % and 45 wt %, where 100 wt % is the sum of the weight percentages of the high-density polyethylene and of the electrically conductive filler.

4. The composite according to claim 3, wherein the electrically conductive filler is in a weight percentage of between 16 wt % and 30 wt %, where 100 wt % is the sum of the weight percentages of the high-density polyethylene and of the electrically conductive filler.

5. The composite according to claim 1, wherein the electrically conductive filler is a carbonaceous filler.

6. The composite according to claim 5, wherein the electrically conductive filler comprises at least one from among carbon black, graphene, carbon nanotubes, or mixtures thereof.

7. The composite according to claim 1, further comprising a thermally conductive filler.

8. The composite according to claim 7, wherein the thermally conductive filler is confined, or mostly confined, in the polyoxymethylene.

9. The composite according to claim 7, wherein the thermally conductive filler comprises at least one from among boron nitride, talc, aluminium nitride, aluminium oxide, and mixtures thereof.

10. The composite according to claim 7, wherein at least one of:

the thermally conductive filler comprises a material having a value of thermal conductivity higher than 200 W/(m·K) at 25° C.;

the thermally conductive filler is confined, or mostly confined, in the polyoxymethylene, in a weight percentage of between 5 wt % and 70 wt %, where 100 wt % is the sum of the weight percentages of the polyoxymethylene and of the thermally conductive filler.

11. An electrical heater device comprising at least one heating element that includes a first electrode, a second electrode, and a material having a PTC effect set at least in part between the first and second electrodes, wherein the material having a PTC effect is a co-continuous polymeric composite according to claim 1.

12. A method for obtaining a co-continuous polymeric composite having PTC effect, which comprises forming a mixture containing at least two immiscible polymers and at least one electrically conductive filler, wherein at least one of said immiscible polymers is high-density polyethylene, wherein at least one other of said immiscible polymers is polyoxymethylene, wherein the electrically conductive filler is previously added to the high-density polyethylene, and the high-density polyethylene containing the electrically conductive filler is subsequently mixed with the polyoxymethylene, the method comprising the steps of:

providing a first master batch of high-density polyethylene having a higher concentration of electrically conductive filler;

providing a second master batch of high-density polyethylene free of electrically conductive filler or having a lower concentration of electrically conductive filler;

mixing the first and second master batches together, and simultaneously or subsequently mixing the resulting mixture with the polyoxymethylene.

13. The method according to claim 12, wherein:

the electrically conductive filler of the first master batch is in a weight percentage of between 10 wt % and 45 wt %, where 100 wt % is the sum of the weight percentages of the high-density polyethylene of the first master batch and of the corresponding electrically conductive filler; and the electrically conductive filler of the second master batch is in a weight percentage of between 0 wt % and 20 wt %, where 100 wt % is the sum of the weight percentages of the high-density polyethylene of the second master batch and of the corresponding electrically conductive filler.

14. The method according to claim 12, comprising adding a thermally conductive filler to the polyoxymethylene, prior to mixing thereof with the high-density polyethylene.

15. An electrical heater device comprising at least one electrode and a co-continuous polymeric composite having PTC effect, wherein the at least one electrode is in contact with a plurality of different materials of a matrix of the co-continuous polymeric composite:

wherein at least one of said different materials is a high-density polyethylene, and at least another one of said different materials is polyoxymethylene, and wherein the high-density polyethylene comprises a first fraction having a higher concentration of electrically conductive filler and a second fraction free of electrically conductive filler or having a lower concentration of electrically conductive filler, the first fraction being mixed with the second fraction and/or at least partially confined within the second fraction.

* * * * *